US007533498B2

(12) United States Patent
Zeigler

(10) Patent No.: US 7,533,498 B2
(45) Date of Patent: May 19, 2009

(54) MECHANICALLY DEPLOYABLE EXPANDABLE AND COLLAPSIBLE STRUCTURE AND METHOD FOR DEPLOYING A STRUCTURE

(75) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 649 days.

(21) Appl. No.: 10/779,636

(22) Filed: Feb. 18, 2004

(65) Prior Publication Data

US 2005/0204681 A1 Sep. 22, 2005

(51) Int. Cl.
*E04B 1/34* (2006.01)
*E04H 15/00* (2006.01)

(52) U.S. Cl. ..... 52/79.5; 52/645; 52/646; 52/86; 135/135; 135/128

(58) Field of Classification Search ..... 52/646, 52/645, 79.5, 63, 80, 86, 113, 222, 6; 135/97, 135/121, 131, 135, 145, 159, 123, 120.3, 135/120.4, 128, 20.1
See application file for complete search history.

(56) References Cited

U.S. PATENT DOCUMENTS 3,354,596 A * 11/1967 Schafer ..... 52/646
3,968,808 A 7/1976 Zeigler
4,026,313 A 5/1977 Zeigler
4,156,433 A * 5/1979 Beaulieu ..... 135/145
4,280,521 A 7/1981 Zeigler
4,290,244 A 9/1981 Zeigler
4,325,207 A * 4/1982 Russell et al. ..... 52/641
4,334,660 A 6/1982 Zeigler
4,437,275 A 3/1984 Zeigler
4,473,986 A 10/1984 Zeigler
4,512,097 A 4/1985 Zeigler
4,522,008 A 6/1985 Zeigler
4,539,786 A * 9/1985 Nelson ..... 52/645
4,539,789 A * 9/1985 Miyano et al. ..... 53/131.2
4,561,618 A 12/1985 Zeigler
4,579,066 A 4/1986 Zeigler
4,614,502 A * 9/1986 Nelson ..... 446/119
4,637,180 A 1/1987 Zeigler
4,666,102 A 5/1987 Zeigler
4,689,932 A 9/1987 Zeigler
4,747,239 A 5/1988 Zeigler
4,761,929 A 8/1988 Zeigler
4,800,663 A 1/1989 Zeigler
4,838,003 A 6/1989 Zeigler (Continued)

*Primary Examiner*—Richard E Chilcot, Jr.
*Assistant Examiner*—Anthony N Bartosik
(74) *Attorney, Agent, or Firm*—WRB-IP LLP

(57) ABSTRACT

A mechanically deployable, expandable and collapsible structure is provided. The structure includes at least one scissor assembly made up of a first and a second strut, a first spacer disposed between the first end of the first strut and the first end of the second strut when the scissor assembly is in the expanded position, and a second spacer disposed between the second end of the first strut and the second end of the second strut when the scissor assembly is in the expanded position. A tension member is connected to the first and second struts. The tension member is arranged such that the scissor assembly is moved from the folded position when there is slack in the tension member to the expanded position when the slack in the tension member is taken up.

41 Claims, 12 Drawing Sheets

U.S. PATENT DOCUMENTS 4,942,686 A * 7/1990 Kemeny ..... 40/610
4,970,841 A 11/1990 Zeigler
RE33,710 E 10/1991 Zeigler
5,230,196 A 7/1993 Zeigler
5,274,980 A 1/1994 Zeigler
5,444,946 A 8/1995 Zeigler
5,632,293 A * 5/1997 Carter ..... 135/145
5,651,228 A 7/1997 Zeigler
5,794,640 A * 8/1998 Jang ..... 135/131
5,930,971 A * 8/1999 Etheridge ..... 52/646
5,943,837 A * 8/1999 Esser et al. ..... 52/646
6,141,934 A 11/2000 Zeigler
2002/0189659 A1 * 12/2002 Carter ..... 135/145
2003/0074845 A1 * 4/2003 Sample et al. ..... 52/63

* cited by examiner

MECHANICALLY DEPLOYABLE EXPANDABLE AND COLLAPSIBLE STRUCTURE AND METHOD FOR DEPLOYING A STRUCTURE

BACKGROUND AND SUMMARY

The present invention relates to expandable and collapsible structures and, more particularly, to mechanically deployable expandable and collapsible structures.

My prior U.S. Pat. Nos. 6,141,934, 5,651,228, 5,444,946, 5,274,980, 5,230,196, RE33,710, 4,970,841, 4,838,003, 4,800,663, 4,761,929, 4,747,239, 4,689,932, 4,666,102, 4,637,180, 4,579,066, 4,561,618, 4,522,008, 4,512,097, 4,473,986, 4,437,275, 4,334,660, 4,290,244, 4,280,521, 4,026,313, and 3,968,808 are incorporated by reference and show various collapsible structures and components therefor. Many expandable and collapsible structures are designed to be erected by workers at ground level. Typically, the workers erect center portions of the structures first, then work their way outward to erect more peripheral portions of the structure. When the erection of the structures is completed, the center portions may be out of the reach of the workers, such as is likely to be the case in the erection of certain of the structures disclosed in U.S. Pat. No. 5,444,946. While experienced workers can often erect these structures in relatively little time, it usually takes a team of workers to erect the structures. Additionally, when the structures are unfolded to a collapsed condition prior to forming the erected structure, the peripheral portions of the structures typically extend outwardly substantially beyond the boundaries of the erected structure because the structures are laid out substantially flat prior to erection into their final shape. This can make it necessary to attach covers to the structures only after the structures are erected because the structures are designed to cover the structures in the erected condition.

It is desirable to provide an expandable and collapsible structure that can have a cover that is attached to the structure when the structure is folded or expanded. It is also desirable to provide a structure that does not need a team of workers to erect the structure.

In accordance with one aspect of the present invention, a mechanically deployable, expandable and collapsible structure is provided. The structure includes at least one scissor assembly comprising a first and a second strut, the first and the second strut each having first and second ends and being pivotably attached to each other such that the scissor assembly is movable between a folded position in which the first end of the first strut and the second end of the second strut are substantially adjacent and an expanded position. The structure also includes a first spacer disposed between the first end of the first strut and the first end of the second strut when the scissor assembly is in the expanded position, and a second spacer disposed between the second end of the first strut and the second end of the second strut when the scissor assembly is in the expanded position. A tension member is connected to the first and second struts. The tension member is arranged such that the scissor assembly is moved from the folded position when there is slack in the tension member to the expanded position when the slack in the tension member is taken up.

In accordance with another aspect of the present invention, a method of deploying a mechanically deployable structure is provided. According to the method, the structure is unfolded to a collapsed condition. The structure includes at least one scissor assembly comprising a first and a second strut, the first and the second strut each having first and second ends and being pivotably attached to each other such that the scissor assembly is movable between a folded position in which the first end of the first strut and the second end of the second strut are substantially adjacent and an expanded position. When the structure is in a collapsed condition, slack in a tension member is taken up, the tension member being connected to the first and second struts in such a manner that taking up slack draws the first ends of the first and second struts toward one another.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
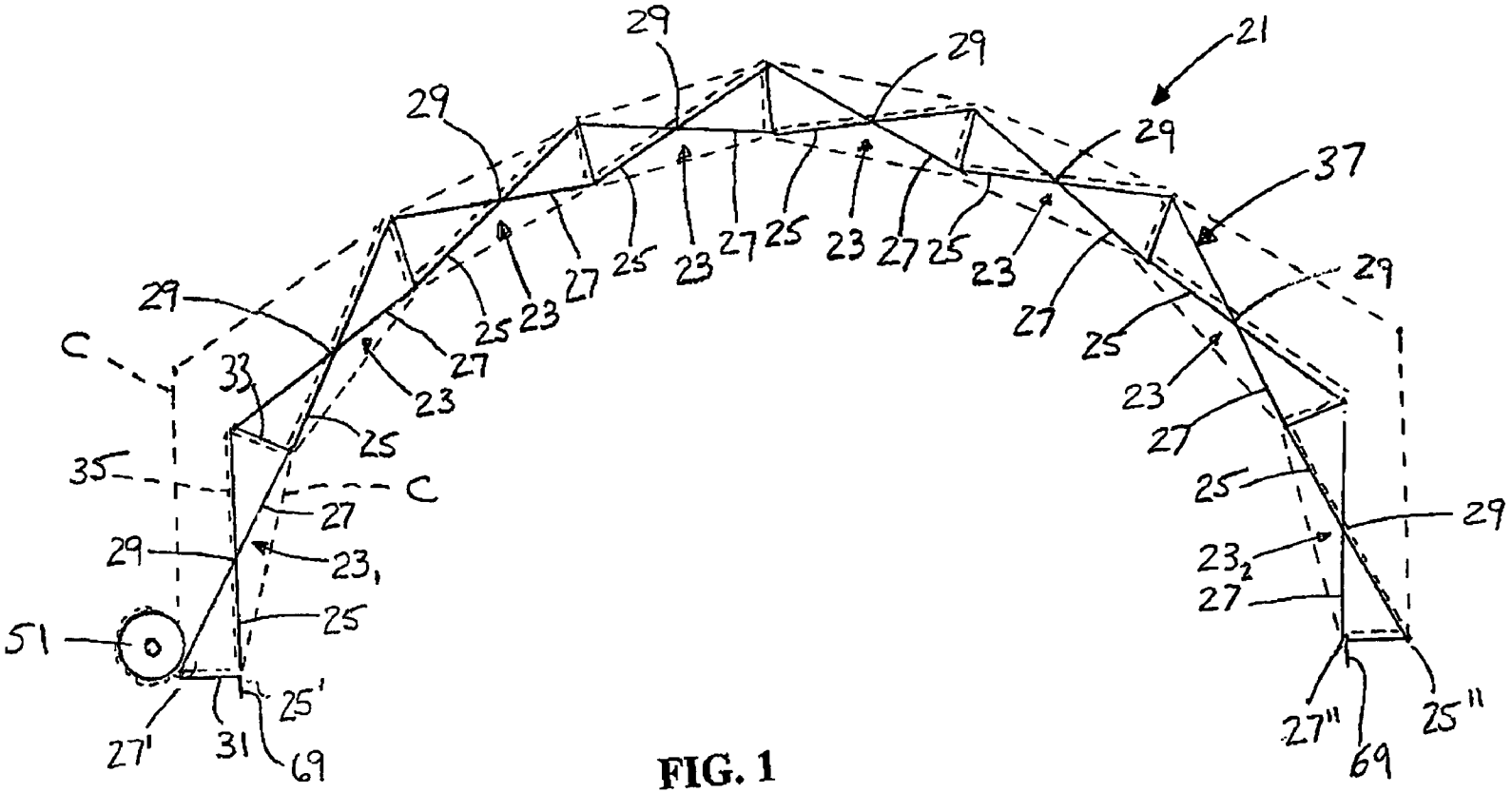
FIG. 1 is a side view of a structure according to an embodiment of the present invention.

A mechanically deployable, expandable and collapsible structure 21 according to an embodiment of the present invention is seen in FIG. 1. The structure 21 will ordinarily include a cover C (shown in phantom) disposed on an inner side and/or an outer side of the structure. The structure 21 includes at least one and ordinarily a plurality of scissor assemblies 23. Each scissor assembly 23 includes a first and a second strut 25 and 27, respectively.

Figure 2A:
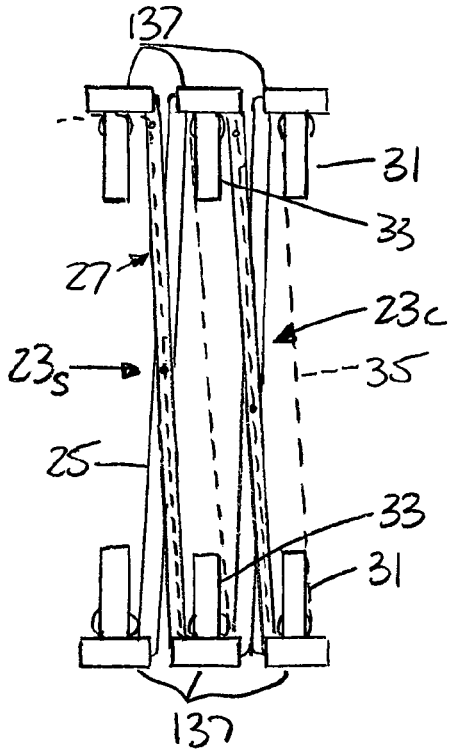
FIGS. 2A and 2B are side views of scissor assemblies according to an embodiment of the present invention in folded and expanded conditions, respectively.
Figure 2B:
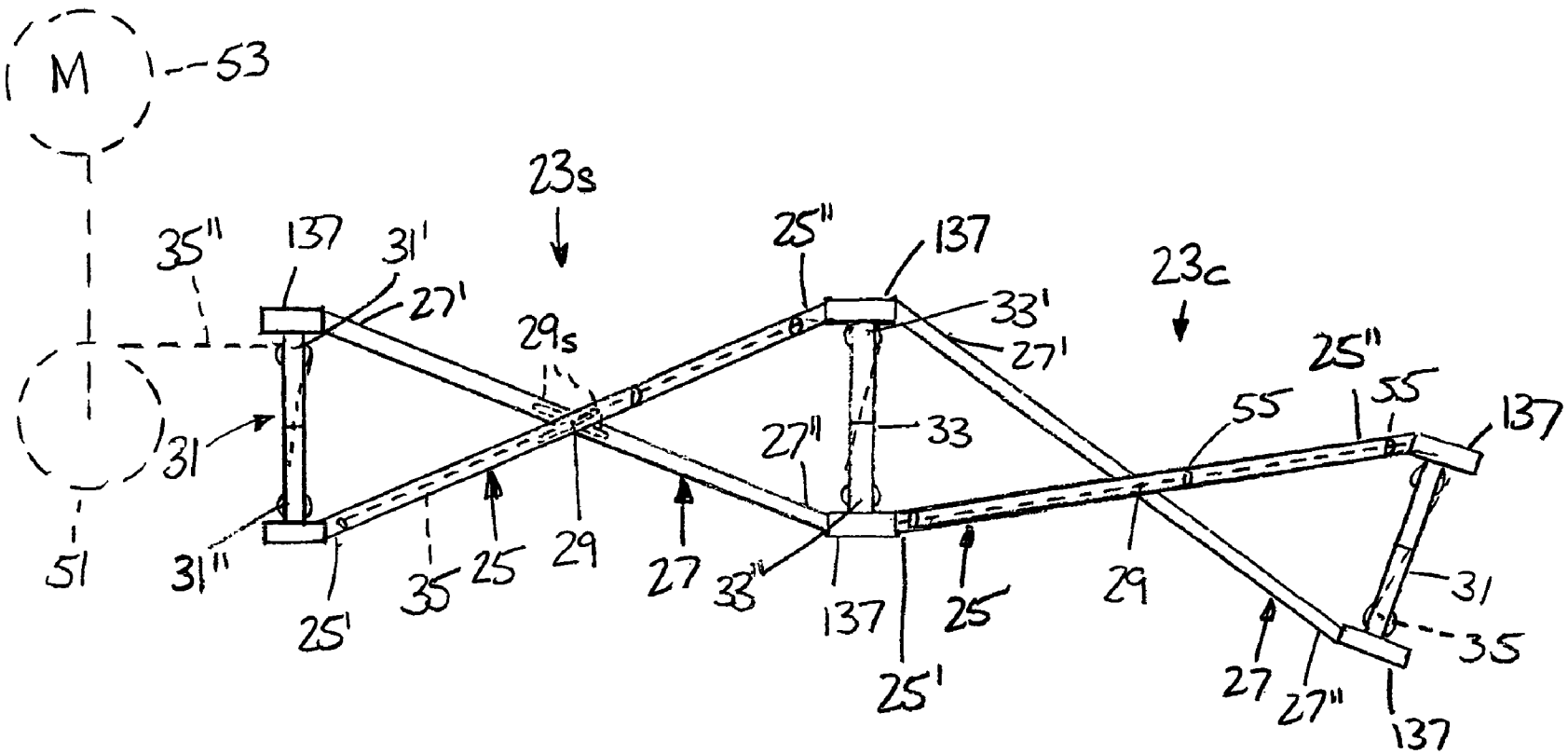

As seen with reference to the scissor assemblies 23*s* and 23*c* in FIGS. 2A and 2B, the first and the second struts 25 and 27 each have first and second ends 25' and 25" and 27' and 27". The second ends 25" and 27" of the first and second struts 25 and 27 of one scissor 23*s* are pivotably connected to the first ends 27' and 25' of the struts 27 an 25 of the succeeding scissor assembly 23*c*. A hub 137 structure to which ends of the struts are attached is ordinarily provided.

The first and second struts 25 and 27 are pivotably attached to each other at a connection point 29 such that the scissor assembly is movable between a folded position (FIG. 2A) in which the first end 25' of the first strut and the second end 27" of the second strut are substantially adjacent and an expanded position (FIG. 2B). When the scissor assemblies 23*s* and 23*c* are in the expanded position, a first spacer 31 is disposed between the first end 25' of the first strut 25 and the first end 27' of the second strut 27, and a second spacer 33 is disposed between the second end 25" of the first strut and the second end 27" of the second strut. The spacers 31 and 33 are ordinarily identical and the references here to first and second spacers is merely for the sake of discussion and is not intended to reflect differences between the spacers.

A tension member 35 is connected to the first and second struts 25 and 27. The tension member 35 is arranged such that the scissor assemblies 23*s* and 23*c* are moved from the folded position when there is slack in the tension member to the expanded position when the slack in the tension member is taken up. The tension member 35 is ordinarily in the form of a cable or similar structure and is adapted to be placed in tension.

The structure 21 (FIG. 1) ordinarily includes a plurality of scissor assemblies 23*s* and 23*c* (FIGS. 2A and 2B) connected end to end such that a second end 27" of a second strut 27 and a second end 25" of a first strut 25 of a first scissor assembly 23*s* is pivotably connected to a first end 25' of a first strut and a first end 27' of a second strut of a second scissor assembly 23*c*, respectively. In this embodiment, the second spacer 33 for the first scissor assembly 23 serves as the first spacer 31 for the second scissor assembly, i.e., successive scissor assemblies share spacers.

Figure 4A:
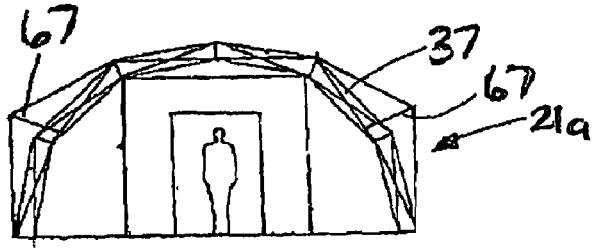
FIGS. 4A, 4B, and 4C are front, top, and side views, respectively, of a structure according to an embodiment of the invention.
Figure 4B:
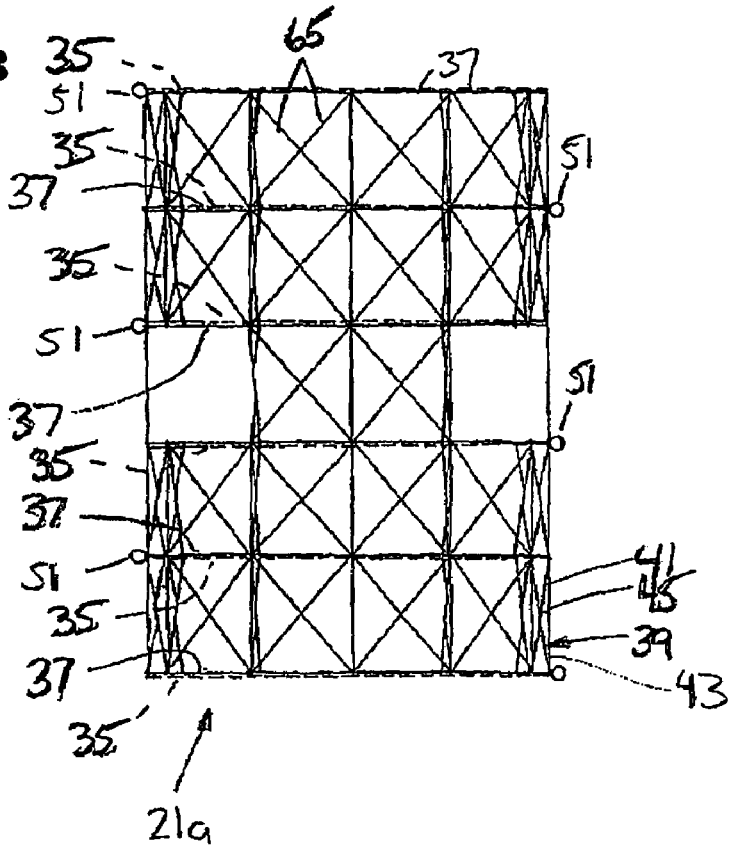
Figure 4C:
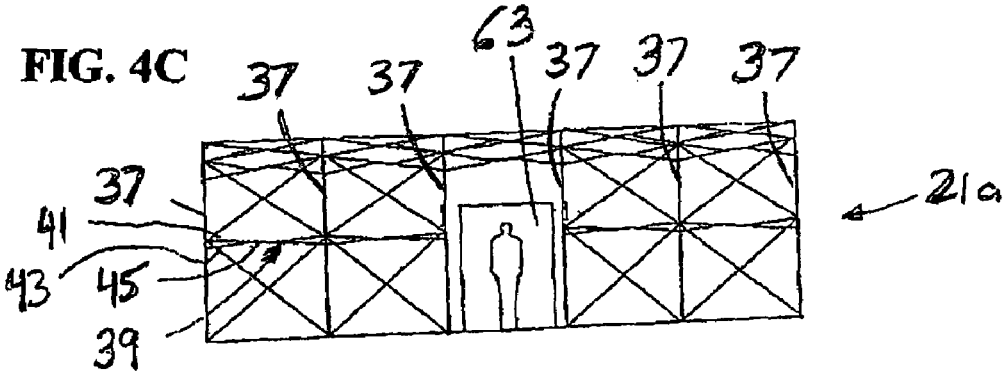

The plurality of scissor assemblies 23 seen in FIG. 1 connected end to end defines what shall be referred to here as a bank 37 of scissor assemblies. The structure 21 ordinarily includes at least two, usually more, banks 37 of scissor assemblies 23. As seen in FIGS. 4B and 4C, at least one lateral scissor assembly 39 is provided and includes first and second struts 41 and 43 pivotably connected at ends thereof to ends of the first and second struts 25 and 27 of at least one scissor assembly of each of the banks of scissor assemblies. Ordinarily, the banks 37 of scissor assemblies 23 are substantially identical and a lateral scissor assembly 39 is disposed at each end of each scissor assembly.

Figure 8A:
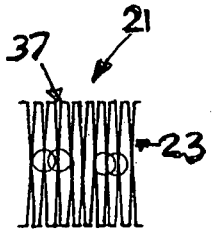
FIGS. 8A-8B show front and side views of a structure and FIGS. 8C and 8D show strut pairs from the front and side of the structure of FIGS. 8A and 8B, respectively, according to an embodiment of the present invention in a folded stage of deployment.
Figure 8B:
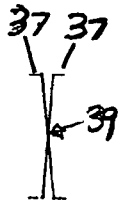
Figure 8C:
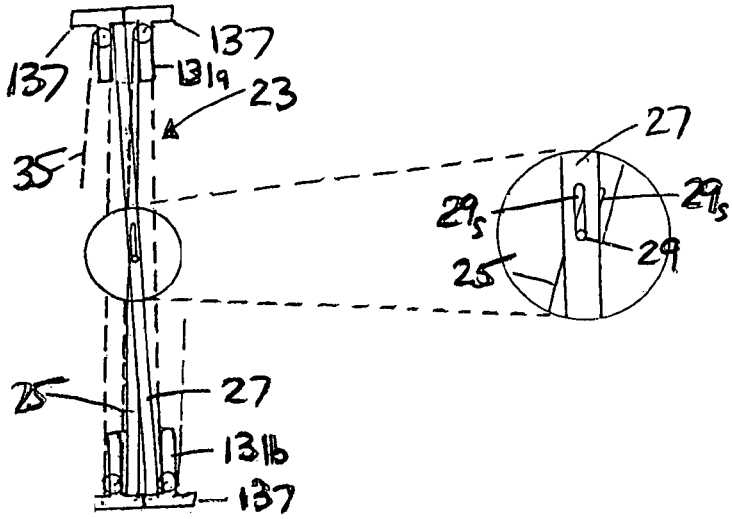
Figure 8D:
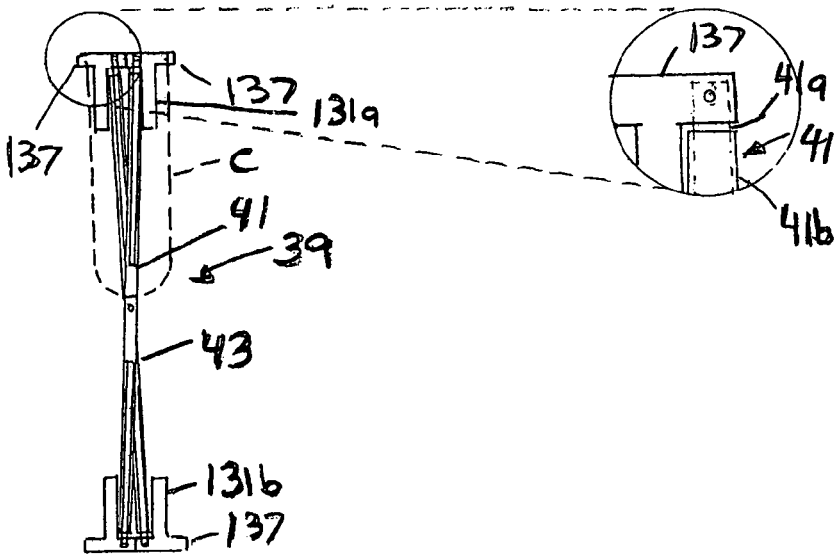
Figure 9A:
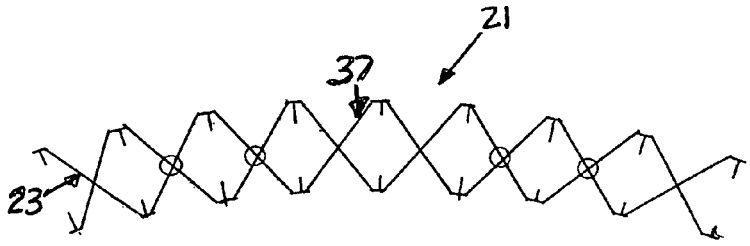
FIGS. 9A-9B show front and side views of a structure and FIGS. 9C and 9D show strut pairs from the front and side of the structure of FIGS. 9A and 9D respectively, according to an embodiment of the present invention in a collapsed stage of deployment.
Figure 9B:
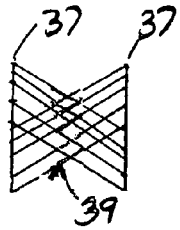
Figure 9C:
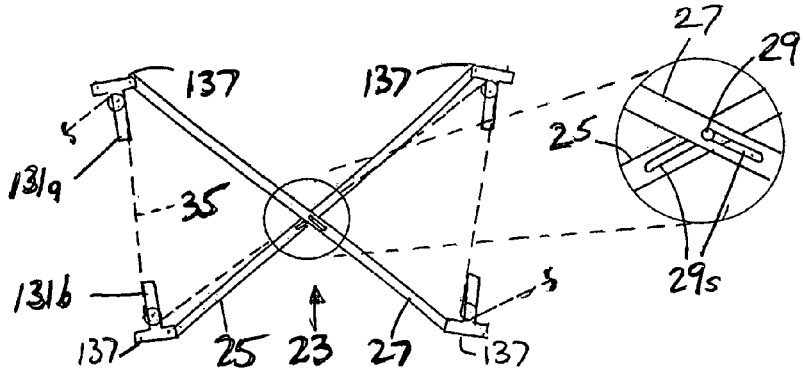
Figure 9D:
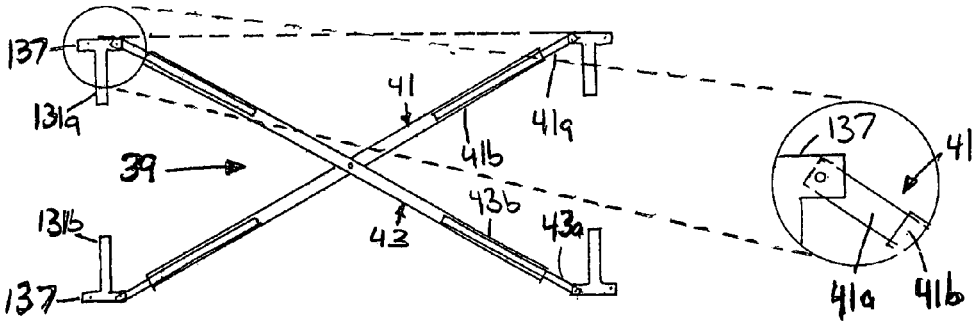
Figure 10A:
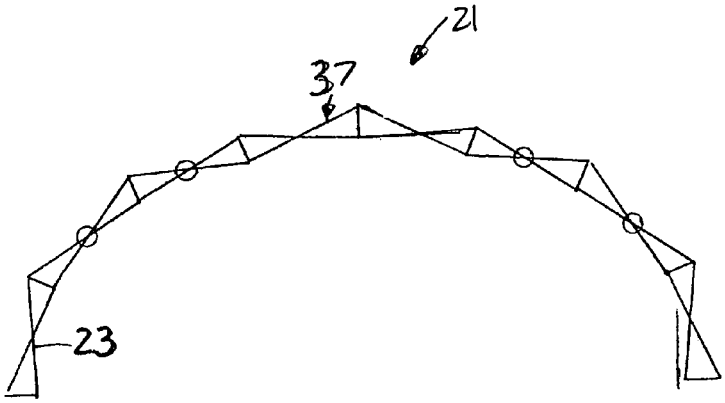
FIGS. 10A-10B show front and side views of a structure and FIGS. 10C and 10D show strut pairs from the front and side of the structure of FIGS. 10A and 10B, respectively, according to an embodiment of the present invention in an expanded stage of deployment.
Figure 10B:
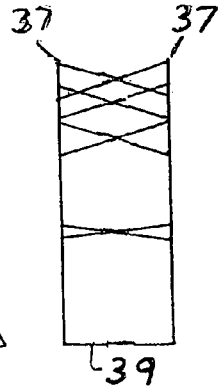
Figure 10C:
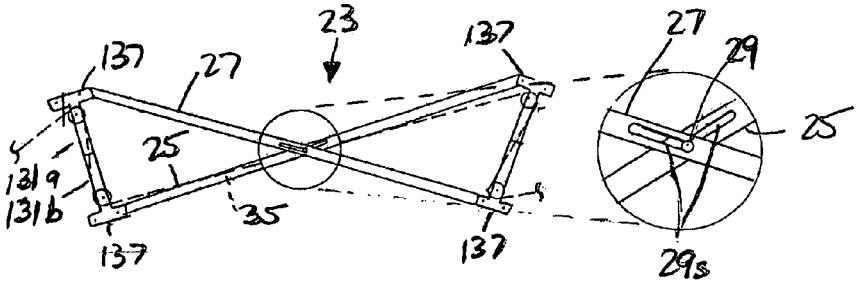
Figure 10D:
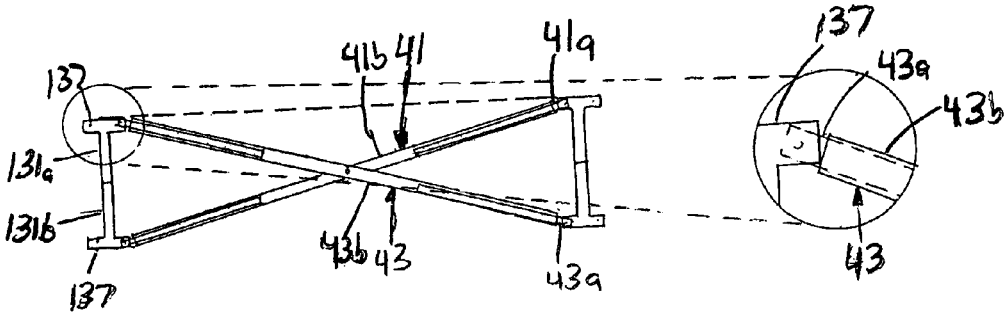

As seen in FIGS. 8D, 9D, and 10D, the first and second struts 41 and 43 of the lateral scissor assemblies 39 are preferably telescoping and include interior telescoping portions 41*a* and 43*a* pivotably connected to the hubs 137 and exterior telescoping portions 41*b* and 43*b* pivotably connected to each other. If desired, of course, the interior portions may be pivotably connected to each other and the exterior portions may be pivotably connected to the hubs. As seen in FIGS. 8A-11F, the use of the telescoping struts in the lateral scissor assemblies 39 facilitates deployment of the structure 21 by permitting the structure to be opened to its full length without opening the banks 37 of scissor assemblies.

As seen in, for example, FIG. 4B, the first and second struts 41 and 43 of each lateral scissor assembly 39 may be pivotably connected to each other at a connection point 45. The first and second struts 41 and 43 may be pivotably connected to each other at centerpoints of the first and second struts. If desired, such as for purposes of forming a structure 21 that is higher in the center than at its ends along an axis of the structure, the first and second struts 41 and 43 may be connected at points offset from the centerpoints of the struts.

As seen in FIG. 2B, ordinarily, the first and second struts 25 and 27 of at least some scissor assemblies 23*s* of the plurality of scissor assemblies are pivotably connected to each other at connection points 29 disposed at centerpoints of the first and second struts. With a connection point 29 at the centerpoints of the struts, lines extending through the first ends of the first and second struts and through the second ends of the first and second struts of the scissor assembly 23*s* are parallel and, in an expanded condition, the scissor assemblies define a substantially rectangular shape. If multiple such scissor assemblies 23*s* are attached, their centerpoints will extend along a straight line.

However, the first and second struts 25 and 27 of at least one other scissor assembly 23*c* of the plurality of scissor assemblies are pivotably connected to each other at points 29 offset from centerpoints of the first and second struts. In this way, lines extending through first ends of the first and second struts and through second ends of the first and second struts of the scissor assembly 23*c* are not parallel and the scissor assembly defines a truncated triangle shape. If multiple such scissor assemblies 23*c* are connected end to end, the centerpoints 29 of the assemblies will lie on a curve.

Ordinarily, the structure 21 will be made up of a combination of straight scissor assemblies 23*s* and curved scissor assemblies 23*c*. The curved scissor assemblies 23*c* may be constructed so that they define truncated triangles of different shape, such as truncated triangles truncated from isosceles triangles with two 75°, 67.5°, 60°, or 45° angles.

As seen in FIG. 1, the plurality of connected scissor assemblies are preferably arranged in a combination of straight scissor assemblies and curved scissor assemblies to define an arch shape when in the expanded condition. The arch includes a first end scissor assembly $23_1$ and a second end scissor assembly $23_2$ at opposite ends of the plurality of connected scissor assemblies. The arch will ordinarily be shaped, through a suitable combination of curved and straight scissor assemblies, such that the first ends 25' and 27' of the first and second struts 25 and 27 of the first end scissor assembly $23_1$ are substantially coplanar with the second ends 25" and 27" of the first and second struts of the second end scissor assembly $23_2$.

The first and second spacers 31 and 33 ordinarily each include tubular or channel-shaped members. As seen in FIG. 2B, the tension member 35 ordinarily extends through at least part of the tubular or channel-shaped first and second spacers 31 and 33, ordinarily from a first end 31' and 33' of each spacer to a second end 31" and 33" of each spacer or proximate the first and second ends. The spacers 31 and 33 may be formed from a single member or, as seen in FIGS. 2A-3D, from plural members. While the spacers 31 and 33 need not be tubular or channel-shaped, it is convenient to extend the tension member 35 through spacers of this type. If desired, the tension member 35 can extend through eyelets of members (not shown) attached to the exterior of solid spacers. The spacers 31 and 33 preferably have pulleys 34 attached thereto to facilitate movement of the tension member 35 relative to the spacers.

As seen in FIG. 2B, it may be desirable to include among the scissor assemblies one or more sliding scissor assemblies having first and second struts that are both pivotably connected and slidable relative to one another. In FIG. 2B, the scissor assembly 23*s* is shown with longitudinal slots 29*s* (FIGS. 8C, 9C, 10C; in phantom in FIG. 2B) in both the first and second struts 25 and 27. The slots 29*s* permit the first and second struts 25 and 27 to slide relative to one another in addition to pivoting. Although FIG. 2B shows both struts 25 and 27 with slots 29*s*, it will be appreciated that a slot may be provided in just one of the struts, as well. Providing slots 29*s* in at least some of the struts of the scissor assemblies has been found to facilitate raising the structure 21 from a collapsed position and provides an additional degree of flexibility to an erected structure, which can be useful in adverse conditions such as high winds. It has been found to be particularly beneficial to provide slots 29*s* in struts closer to the lateral ends of the structure, although slots may be provided in struts near the top of the erected structure, if desired. If desired, pivot pins can be omitted entirely in some scissor assemblies.

Figure 3B:
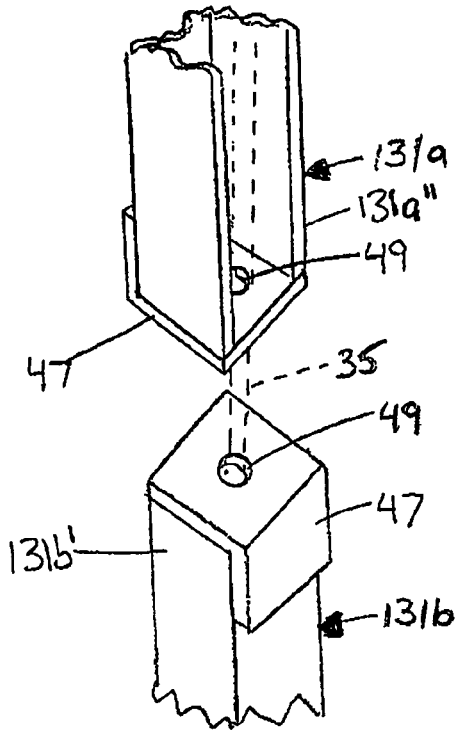
FIG. 3B is a broken, perspective view of a spacer according to an embodiment of the present invention.
Figure 3A:
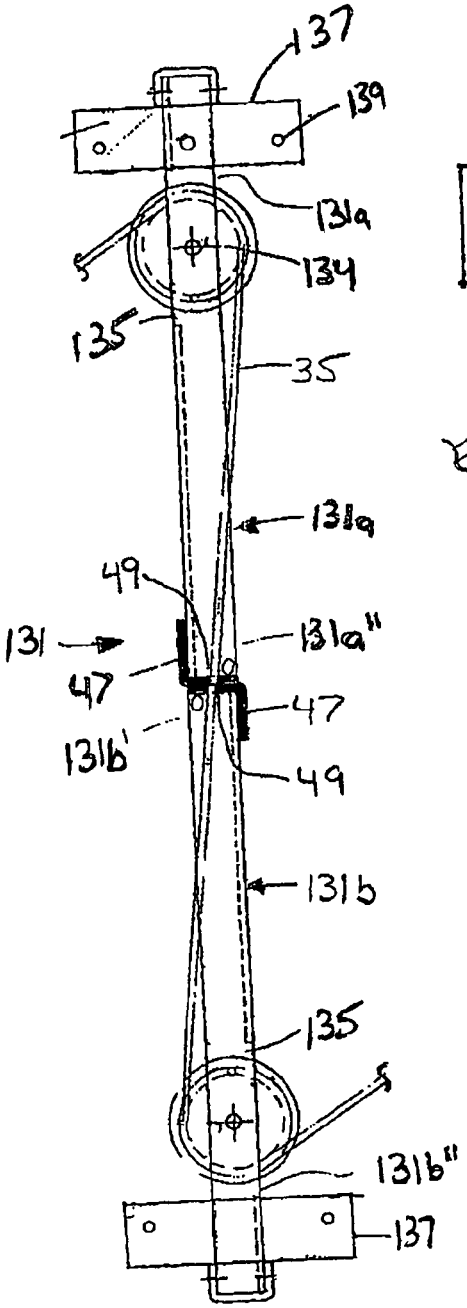
FIGS. 3A, 3C, and 3D are side, partially cross-sectional views of spacers according to embodiments of the present invention.

As seen in FIG. 3A, spacers 131 may instead include separable first and second halves 131*a* and 131*b*. Ends of the first and second halves 131*a* and 131*b* are caused to abut when the slack in the tension member 35 is taken up. As seen in FIGS. 3A and 3B, the abutting ends 131*a*" and 131*b*' of the first and second halves of the spacers can be capped by caps 47 that have holes 49 formed therein that are preferably substantially the same size as the tension member 35. When slack in the tension member 35 is taken up, the holes 49 and their associated spacer halves 131*a* and 131*b* will align as seen in FIG. 3A.

As seen in FIG. 3A, the spacer halves 131*a* and 131*b* are preferably provided with pulleys 134 attached to the spacers at first and second ends 131*a*' and 131*b*" of the spacer halves. The pulleys 134 can be disposed in cut-out regions 135 of the spacer halves as shown in FIGS. 3A, 3C, and 3D, but may also be attached to the spacers in any number of suitable ways.

Figure 3C:
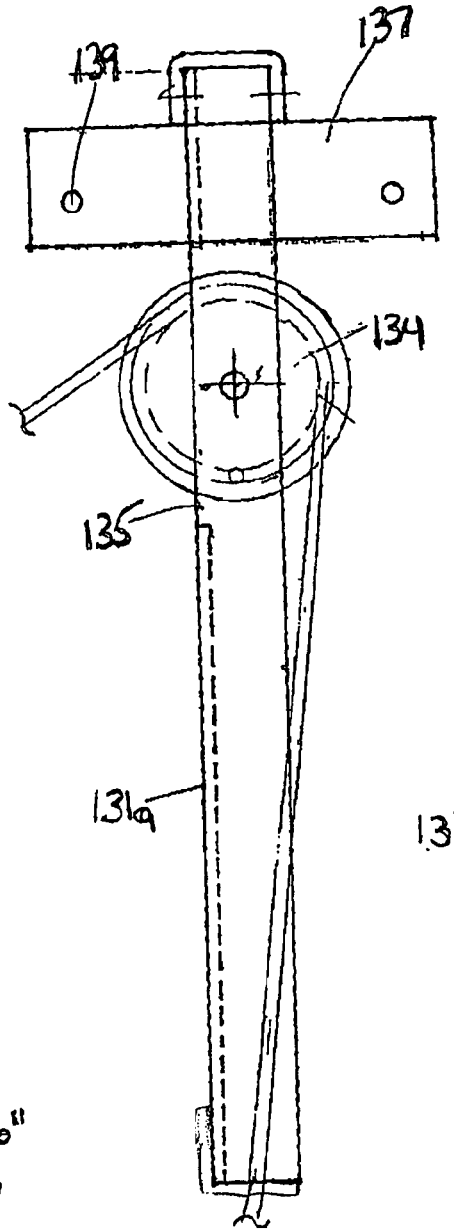
Figure 3D:
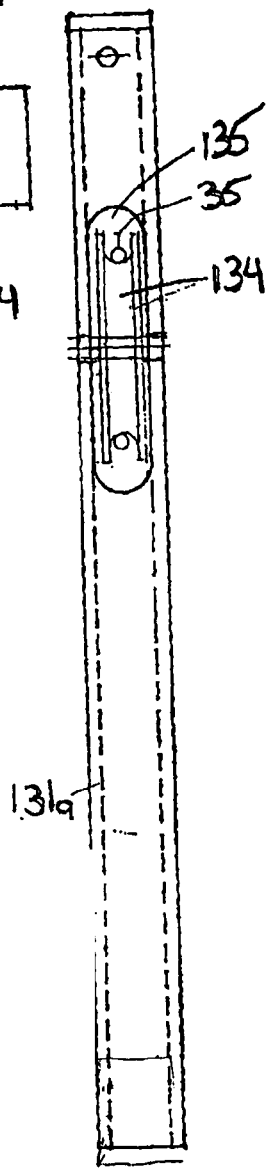

As seen in FIGS. 3A and 3C, the spacer halves 131*a* and 131*b* can also be attached to hubs 137 to which the ends of the first and second struts of the scissor assemblies 23 can be pivotably attached. The hubs 137 may be in the form of hubs such as are disclosed in U.S. Pat. No. 4,280,521 or other ones of the patents that are incorporated by reference. The hubs 137 shown in FIGS. 3A and 3C, however, are flanges with openings 139 to receive pivot pins that extend through openings at the ends of the first and second struts. The flanges are riveted to the spacer halves 131.

Figure 5A:
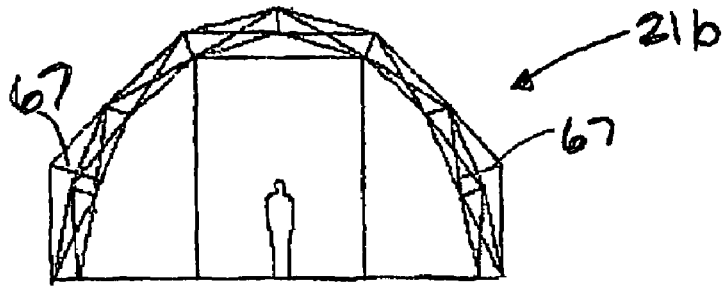
FIGS. 5A, 5B, and 5C are front, top, and side views, respectively, of a structure according to an embodiment of the invention.
Figure 5B:
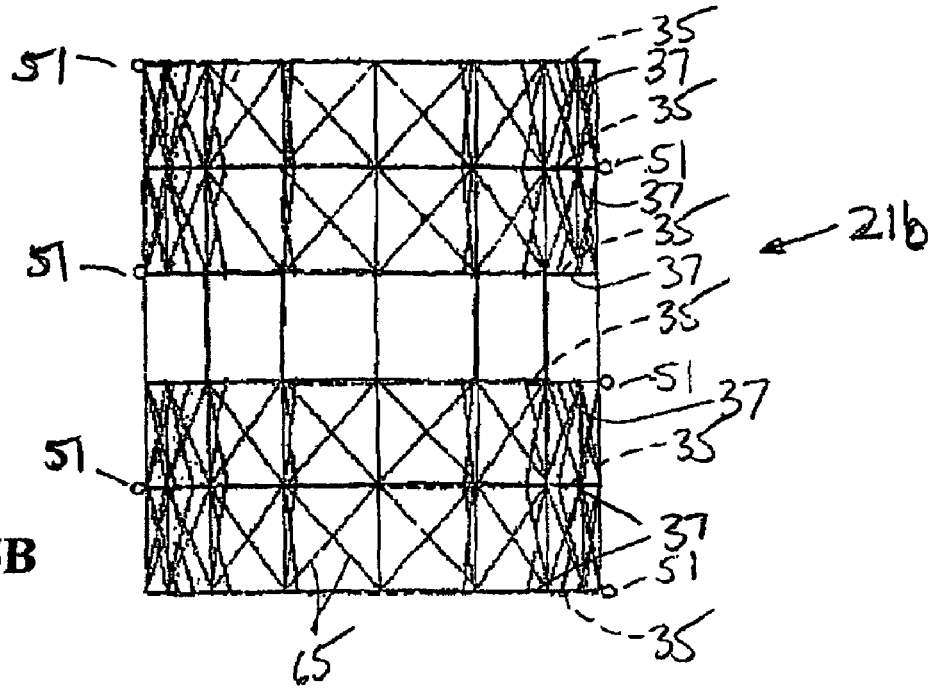
Figure 5C:
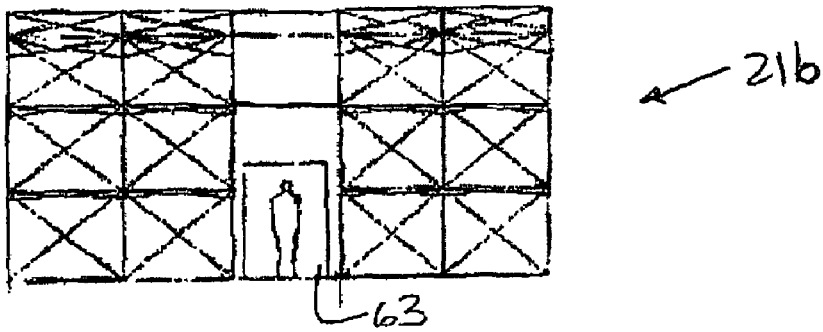
Figure 6A:
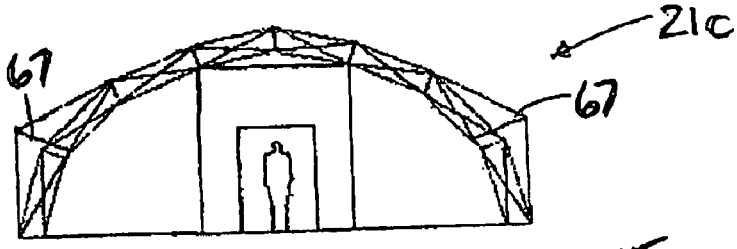
FIGS. 6A, 6B, and 6C are front, top, and side views, respectively, of a structure according to an embodiment of the invention.
Figure 6B:
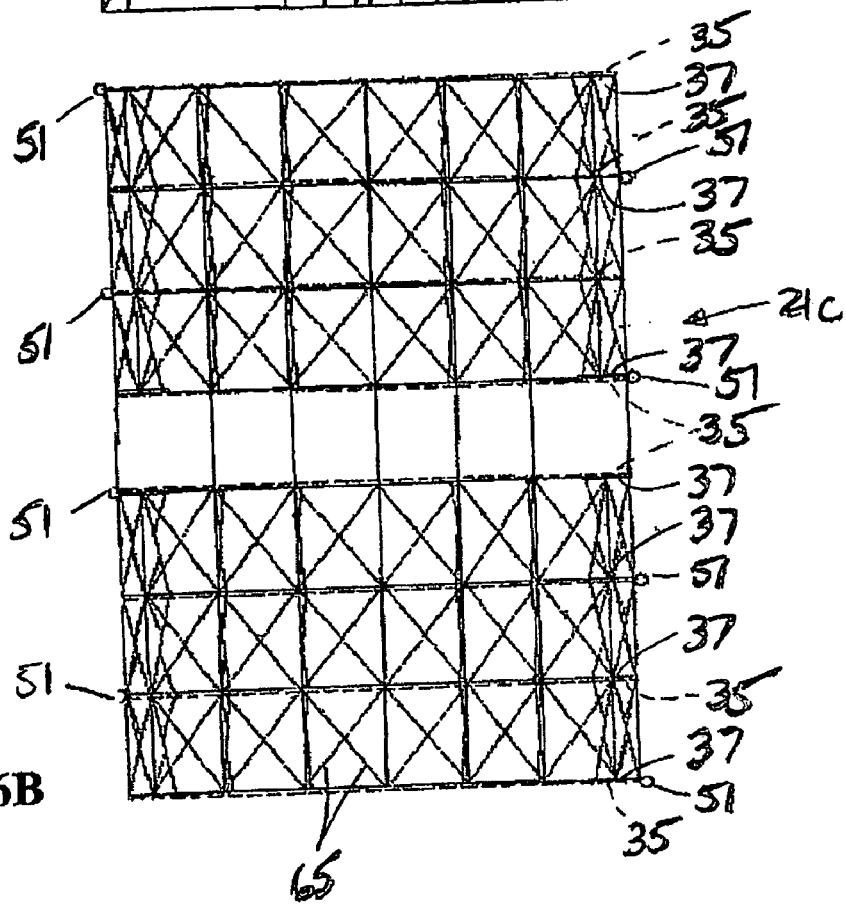
Figure 6C:
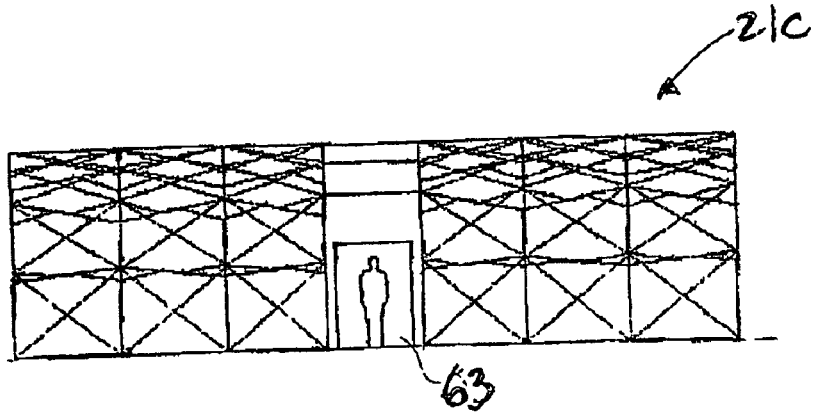

As seen in FIG. 2B, the tension member 35 is ordinarily fixed at one end 35' to an end of a scissor assembly, in this case the scissor assembly 23*c*. A reel 51 is disposed at an opposite end 35" of the tension member 35. The reel 51 may be attached directly to a scissor assembly or disposed remote from the scissor assemblies. The reel 51 is adapted to take up and release slack in the tension member 35. The reel 51 may be manually operated or driven by a motor 53. Where the structure includes multiple banks of scissor assemblies, it may be convenient to arrange reels on opposite ends of alternating ones of the scissor assemblies as seen in FIGS. 4B, 5B, and 6B. Additionally, if desired, multiple reels can be driven by a common drive member which can be manually operated or driven by a single motor.

As seen in FIG. 2B, the tension member 35 extends from a first end of at least one of the first and second struts 25 and 27 to a second end of the one of the first and second struts. In FIG. 2B, the tension member 35 extends from a first end 27' of the second strut 27 proximate where the reel 51 is mounted, through or along the first spacer 31 to the first end 25' of the first strut 25, through or along the first strut 25 to the second end 25" of the first strut, and through or along the second spacer 33 to the second end 27" of the second strut. At points between the reel 51 and the point where the first end 35' of the tension member 35 is disposed, the tension member ordinarily extends over pulleys 57 attached to the ends of the struts 25 and 27 of each scissor assembly 23 in the structure and/or to the spacers 31 and 33 or 131. Additional guides for the tension member 35 such as eyelet members 55 secured to the struts 25 and 27 can also be provided.

FIGS. 4A-4C, 5A-5C, and 6A-6C show structures 21*a*, 21*b*, and 21*c*, respectively, having various configurations of curved and straight scissors arranged in banks to form different shapes. The shapes of the structures 21*a*, 21*b*, and 21*c* are substantially the same size along their length, i.e., the structures define arches of substantially constant size.

Figure 7A:
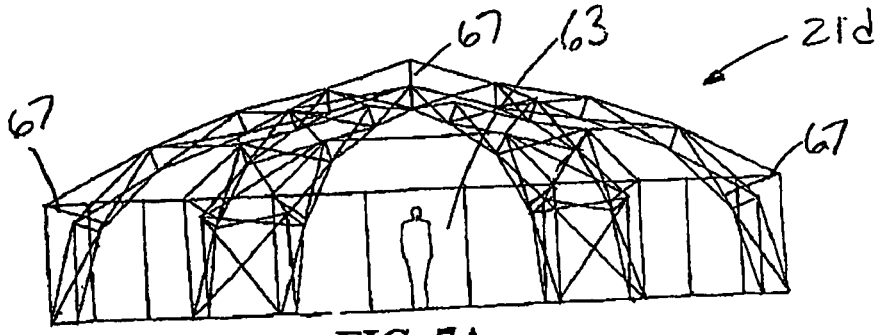
FIGS. 7A and 7B are front and top views, respectively, of a structure according to an embodiment of the invention.
Figure 7B:
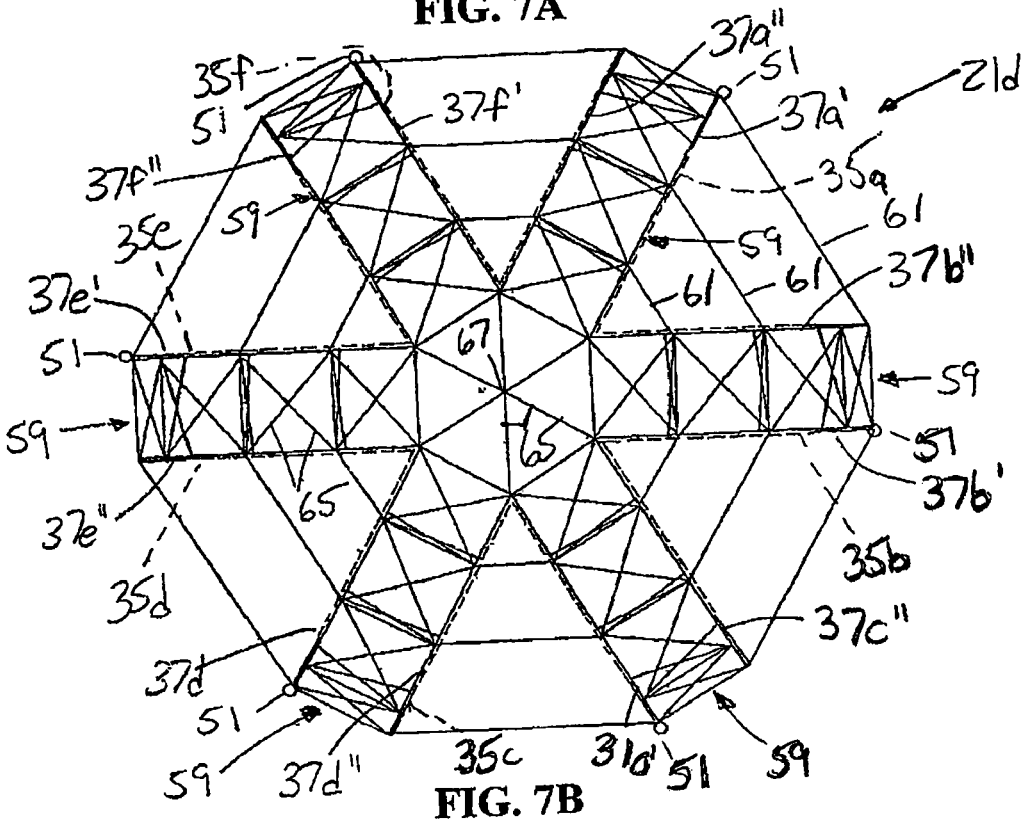

As seen in FIGS. 7A and 7B, structures 21*d* with different configurations may also be provided. In the structures 21*d*, tension members 35*a*, 35*b*, 35*c*, 35*d*, 35*e*, 35*f* are each connected to a reel 51 and extend along two non-parallel, consecutive banks 37*a*' and 37*b*", 37*b*' and 37*c*", 37*c*' and 37*d*", 37*d*' and 37*e*", 37*e*' and 37*f*', and 37 *f*', and 37*a*", respectively. Two parallel, consecutive banks 37*a*' and 37*a*", . . . , 37*f*' and 37*f*" define one of six radially extending leg structures 59. The legs 59 can be connected to one another by other tension members 61 such as cables or structure covers or struts.

In all of the structures shown in FIGS. 4A-4C, 5A-5C, 6A-6C, and 7A-7B, lateral scissor assemblies or tension members can be selectively omitted between otherwise connected banks 37 to facilitate providing entrances 63 for the structures. Tension members 65 such as cables preferably extend diagonally across modules defined by scissor assembly pairs on adjacent banks and adjacent lateral scissor assembly pairs to provide additional strength to the structures. Masts 67 are preferably provided along the sides of the structures 21, 21*a*, 21*b*, 21*c*, and 21*d*, and at the top of the structure 21*d* to assist in forming the structures, such as by providing higher roof peaks or vertical walls. The masts 67 can be supported by tension members or attached to struts.

Figure 11A:
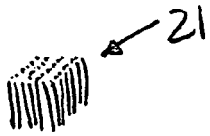
FIGS. 11A-11F show perspective views of phases of erection of a structure according to an embodiment of the present invention.
Figure 11B:
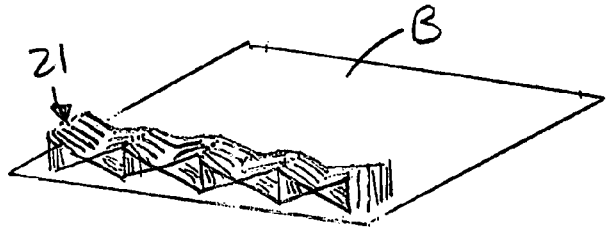
Figure 11C:
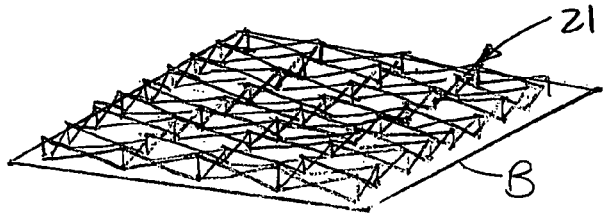

A method of deploying a mechanically deployable structure 21 is described with reference to FIGS. 8A-11F. The structure 21 is unfolded from the folded condition shown in FIGS. 8A-8D and 11A to a collapsed condition. The structure 21 may be unfolded only along its length dimension as shown in FIG. 11B by unfolding and extending the telescoping struts 41 and 43 of the lateral scissors 39 without also unfolding the struts 25 and 27 of the scissors 23. An edge of the structure 21 can be secured to a base B such as the ground or a portable, prefabricated base, and the structure can then be extended to its full width as seen in FIG. 11C where the opposite edge of the structure can be secured to the base. The connection to the ground or base may be by any suitable means, such as a stake 69 (FIG. 1) or by protrusions (not shown) provided in a base B (FIGS. 11B-11F) that mate with holes in flanges extending from the ends of the scissor assemblies $\mathbf{23}_1$ and $\mathbf{23}_2$ at opposite ends of the bank 37 of scissor assemblies. If desired, of course, the structure 21 may be expanded from the condition in FIG. 11A to the condition in FIG. 11C without expanding the structure to the condition shown in FIG. 11B, i.e., the structure can be expanded along its length and along its width substantially simultaneously.

Figure 11D:
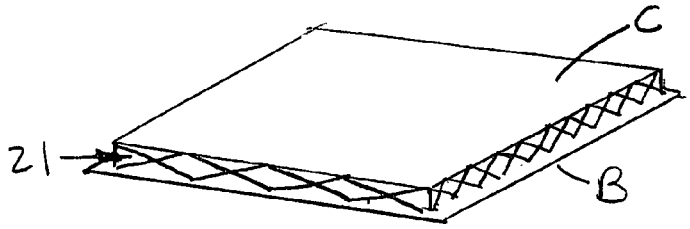
Figure 11E:
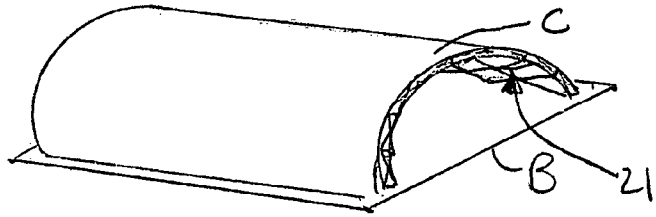
Figure 11F:
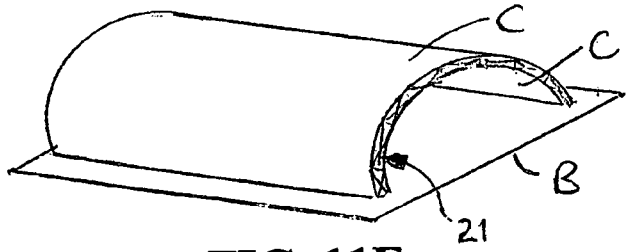

Because the structure 21 need not extend beyond its erected base dimensions during erection, any covers desired on the structure can remain on the structure 21 at all times, even during folding, or may be removed prior to folding. As seen in FIG. 11D, once the structure 21 is fixed to a base B yet not fully erected, so that the still collapsed structure is fit atop the footprint of the final shape of the structure, if not already on the structure, an outer cover C can be attached. The structure 21 can then be erected to its final shape as seen in FIG. 11E and, if not already attached to the structure, an inner cover C can be attached as seen in FIG. 11F.

FIGS. 8A and 8B show a structure 21 in a folded condition. FIG. 8C shows a folded scissor assembly 23 with an enlarged view of the location of a pivot pin 29 in the slots 29*s* in the struts 25 and 27. The scissor assembly 23 with slots 29*s* is ordinarily a curved scissor assembly. FIG. 8D shows a folded lateral scissor assembly 39 in which the telescoping portions 41*a* and 41*b* and 43*a* and 43*b* of the struts 41 and 43 are telescoped in a substantially closed condition.

FIGS. 9A and 9B show the structure 21 in a partially expanded, but still collapsed condition. Comparing FIGS. 8C and 9C shows the relative movement of the pivot pin 29 relative to the slots 29*s* that may occur during erection of the structure 21. FIG. 9D shows the telescoping portions 41*a* and 41*b* and 43*a* and 43*b* of the struts 41 and 43 telescoped outwardly to a point where an attached cover C is placed in tension, after which it is no longer possible to extend the telescoping portions. Preferably, the telescoping portions are sized such that the cover C can be placed in tension while the scissor assembly 23 remains in the folded condition shown in FIG. 8C so that the structure can be extended along its length dimension and connected to a base B (FIGS. 11B-11F) before unfolding the scissor assemblies 23.

FIGS. 10A and 10B show the structure 21 in an expanded condition. In this condition, the spacer halves 131*a* and 131*b* are disposed adjacent to one another. In the scissor assembly 23, the pivot pin 29 will reach a final position relative to the slots 29*s* in the struts 25 and 27, although flexing of the scissor assembly may result in relative movement of the pin and the slots. The telescoping portions 41*a* and 41*b* and 43*a* and 43*b* of the struts 41 and 43 telescope back inwardly to a final position as seen in FIG. 10D.

With reference to FIG. 1, when the structure 21 is in a collapsed condition, slack in the tension member 35 is taken up by operating the reel 51. The tension member 35 is connected to the first and second struts 25 and 27 of the connected scissor assemblies in such a manner that taking up slack draws the first ends 25' and 27' of the first and second struts toward one another. The second ends 25" and 27" of the first and second struts will also ordinarily be drawn toward one another at the same time. Slack in the tension member 35 is taken up until the first ends 25' and 27' of the first and second struts 25 and 27 are separated by a distance defined by the first spacer 31. Taking up slack in the tension member 35 also draws the second ends 25" and 27" of the first and second struts 25 and 27 together until they are separated by a distance defined by the second spacer 33.

When the structure 21 includes two or more banks 37 of scissor assemblies 23, slack in tension members 35 corresponding to each bank of scissor assemblies is taken up. The slack in the multiple tension members 35 can be taken up substantially simultaneously, such as by driving all of the reels by a common drive. Of course, if desired, slack in the tension members 35 can be taken up at different times.

While this invention has been illustrated and described in accordance with a preferred embodiment, it is recognized that variations and changes may be made therein without departing from the invention as set forth in the claims.

What is claimed is:

1. A mechanically deployable, expandable and collapsible structure, comprising:

at least one scissor assembly comprising a first and a second strut, the first and the second strut each having first and second ends and being pivotably attached to each other such that the scissor assembly is movable between a folded position, in which the first end of the first strut and the second end of the second strut are substantially adjacent, and an expanded position;

a first spacer disposed between the first end of the first strut and the first end of the second strut when the scissor assembly is in the expanded position, the first spacer comprising a rigid element having a fixed length between a first end proximate the first end of the first strut and a second end proximate the first end of the second strut;

a second spacer disposed between the second end of the first strut and the second end of the second strut when the scissor assembly is in the expanded position; and a tension member connected to the first and second struts, wherein the tension member is arranged such that the scissor assembly is moved from the folded position when there is slack in the tension member to the expanded position when the slack in the tension member is taken up, the first and second spacers each include tubular members, and the tension member extends longitudinally through at least part of the first spacer between the first end and the second end of the first spacer.

2. The mechanically deployable structure as set forth in claim 1, comprising a plurality of scissor assemblies connected end to end such that a second end of a second strut and a second end of a first strut of a first scissor assembly is pivotably connected to a first end of a first strut and a first end of a second strut of a second scissor assembly, respectively, the second spacer for the first scissor assembly serving as the first spacer for the second scissor assembly.

3. The mechanically deployable structure as set forth in claim 2, wherein the plurality of scissor assemblies connected end to end defines a bank of scissor assemblies, the structure including at least two banks of scissor assemblies and at least one lateral scissor assembly including first and second struts pivotably connected at ends thereof to ends of the first and second struts of at least one scissor assembly of each of the banks of scissor assemblies.

4. The mechanically deployable structure as set forth in claim 3, wherein at least two banks of scissor assemblies are substantially identical.

5. The mechanically deployable structure as set forth in claim 4, wherein at least one lateral scissor assembly is disposed at each end of each scissor assembly.

6. The mechanically deployable structure as set forth in claim 3, wherein the first and second struts of each lateral scissor assembly are pivotably connected to each other.

7. The mechanically deployable structure as set forth in claim 6, wherein the first and second struts of each lateral scissor assembly are pivotably connected to each other at centerpoints of the first and second struts.

8. The mechanically deployable structure as set forth in claim 3, further comprising a cover disposed on at least one of an inner side and an outer side of the connected banks of scissor assemblies.

9. The mechanically deployable structure as set forth in claim 8, wherein a cover is disposed on the outer side of the connected banks of scissor assemblies.

10. The mechanically deployable structure as set forth in claim 9, wherein a cover is disposed on the inner side of the connected banks of scissor assemblies.

11. The mechanically deployable structure as set forth in claim 3, wherein the first and second struts of the lateral scissor assembly are telescoping struts.

12. The mechanically deployable structure as set forth in claim 2, wherein the first and second struts of at least one scissor assembly of the plurality of scissor assemblies are pivotably connected to each other at centerpoints of the first and second struts.

13. The mechanically deployable structure as set forth in claim 12, wherein the first and second struts of at least one other scissor assembly of the plurality of scissor assemblies are pivotably connected to each other at points offset from centerpoints of the first and second struts.

14. The mechanically deployable structure as set forth in claim 2, wherein the first and second struts of at least one scissor assembly of the plurality of scissor assemblies are pivotably connected to each other at points offset from centerpoints of the first and second struts.

15. The mechanically deployable structure as set forth in claim 1, wherein the first and second spacers each include tubular members.

16. The mechanically deployable structure as set forth in claim 1, wherein the tension member extends through the first and second spacers from a first end of each spacer to a second end of each spacer.

17. The mechanically deployable structure as set forth in claim 15, wherein the tubular members each include separable first and second halves, ends of the first and second halves abutting when the slack in the tension member is taken up.

18. The mechanically deployable structure as set forth in claim 1, wherein the tension member is fixed at one end to an end of the at least one scissor assembly.

19. The mechanically deployable structure as set forth in claim 18, further comprising a reel secured at an opposite end of the tension member, the reel being adapted to take up and release slack in the tension member.

20. The mechanically deployable structure as set forth in claim 19, further comprising a motor for operating the reel.

21. The mechanically deployable structure as set forth in claim 1, further comprising a reel secured at at least one end of the tension member, the reel being adapted to take up and release slack in the tension member.

22. The mechanically deployable structure as set forth in claim 1, wherein the tension member extends from a first end of at least one of the first and second struts to a second end of the one of the first and second struts.

23. The mechanically deployable structure as set forth in claim 22, comprising at least one pulley disposed at at least one of the first and second ends of at least one of the first and second struts, the tension member extending around the pulley.

24. The mechanically deployable structure as set forth in claim 1, wherein the tension member extends from a first end of the first strut to a second end of the first strut.

25. The mechanically deployable structure as set forth in claim 24, wherein the tension member extends from a first end of the second strut to a second end of the second strut.

26. The mechanically deployable structure as set forth in claim 25, comprising at least one pulley disposed at at least one of the first and second ends of at least one of the first and second struts, the tension member extending around the pulley.

27. The mechanically deployable structure as set forth in claim 1, comprising a plurality of scissor assemblies connected end to end such that a second end of a second strut and a second end of a first strut of a first scissor assembly is pivotably connected to a first end of a first strut and a first end of a second strut of a second scissor assembly, respectively, the plurality of connected scissor assemblies defining an arch shape when in the expanded condition.

28. The mechanically deployable structure as set forth in claim 27, wherein the plurality of connected scissor assemblies includes a first end scissor assembly and a second end scissor assembly at opposite ends of the plurality of connected scissor assemblies, the arch being shaped such that the first ends of the first and second struts of the first end scissor assembly are substantially coplanar with the second ends of the first and second struts of the second end scissor assembly.

29. The mechanically deployable structure as set forth in claim 1, wherein the at least one scissor assembly includes at least one sliding scissor assembly, first and second struts of the sliding scissor assembly being pivotably connected and slidable relative to one another.

30. The mechanically deployable structure as set forth in claim 29, wherein at least one of the first and second struts of the at least one sliding scissor assembly includes a longitudinal groove, a pivot pin extending through the longitudinal groove pivotably and slidably connecting the first and second struts of the at least one sliding scissor assembly.

31. A method of deploying a mechanically deployable structure, comprising:

unfolding the structure to a collapsed condition, the structure including at least one scissor assembly comprising a first and a second strut, the first and the second strut each having first and second ends and being pivotably attached to each other such that the scissor assembly is movable between a folded position, in which the first end of the first strut and the second end of the second strut are substantially adjacent, and an expanded position; and when the structure is in a collapsed condition, taking up slack in a tension member, the tension member being connected to the first and second struts in such a manner that taking up slack draws the first ends of the first and second struts toward one another, and wherein slack in the tension member is taken up until the first ends of the first and second struts are separated by a predetermined distance defined by a rigid spacer, the rigid spacer including a first end and a second end and a tubular member, the tension member extending longitudinally through at least part of the rigid spacer between the first end and the second end of the rigid spacer.

32. The method as set forth in claim 31, wherein slack in the tension member is taken up until the second ends of the first and second struts are separated by a distance defined by a second spacer.

33. The method as set forth in claim 31, wherein the structure includes a plurality of scissor assemblies connected end to end, the method including, after unfolding the structure from the folded position to the collapsed condition and before taking up slack in the tension member, securing at least one of a first and second strut of a scissor assembly at a first end of the plurality of connected scissor assemblies and at least one of a first and second strut of a scissor assembly at a second end of the plurality of connected scissor assemblies to a base.

34. The method as set forth in claim 33, wherein the plurality of scissor assemblies connected end to end defines a bank of scissor assemblies, the structure including at least two banks of scissor assemblies and at least one lateral strut connecting the banks of scissor assemblies, the method including taking up slack in tension members corresponding to each bank of scissor assemblies.

35. The method as set forth in claim 34, wherein slack in the tension members corresponding to each bank of scissor assemblies is taken up substantially simultaneously.

36. The method as set forth in claim 34, wherein slack in the tension members corresponding to each bank of scissor assemblies is taken up at different times.

37. The method as set forth in claim 34, wherein the plurality of scissor assemblies connected end to end defines a bank of scissor assemblies, the structure including at least two banks of scissor assemblies and at least one lateral scissor assembly connecting the banks of scissor assemblies, the method including unfolding the at least one lateral scissor assembly before unfolding the scissor assemblies in the at least two banks of scissor assemblies.

38. The method as set forth in claim 37, wherein unfolding the at least one lateral scissor assembly includes telescoping struts of the at least one lateral scissor assembly.

39. The method as set forth in claim 34, wherein the plurality of scissor assemblies connected end to end defines a bank of scissor assemblies, the structure including at least two banks of scissor assemblies and at least one lateral scissor assembly connecting the banks of scissor assemblies, the method including unfolding the at least one lateral scissor assembly substantially simultaneously with unfolding the scissor assemblies in the at least two banks of scissor assemblies.

40. The method as set forth in claim 31, wherein, when the spacer separates the first ends of the first and second struts, the first ends of the first and second struts are adapted to move away from each other against a tension force of the tension member.

41. The mechanically deployable structure as set forth in claim 1, wherein the first spacer limits movement of the first end of the first strut toward the first end of the second strut and the second spacer limits movement of the second end of the first strut toward the second end of the second strut, the tension member limits movement of the first end of the first strut away from the first end of the second strut, and the tension member limits movement of the second end of the first strut away from the second end of the second strut.

* * * * *